US006616294B1

(12) United States Patent
Henry

(10) Patent No.: US 6,616,294 B1
(45) Date of Patent: Sep. 9, 2003

(54) HARD HAT MOUNTED FLASHLIGHT HOLDER

(76) Inventor: David Vincent Henry, 144 Blue Ridge La., Seymour, TN (US) 37865

( * ) Notice: Subject to any disclaimer, the term of this patent is extended or adjusted under 35 U.S.C. 154(b) by 0 days.

(21) Appl. No.: 10/337,618

(22) Filed: Jan. 7, 2003

(51) Int. Cl.[7] ..... F21V 21/084

(52) U.S. Cl. ..... 362/106; 362/105; 362/191; 2/422; 2/6.2; 224/181

(58) Field of Search ..... 362/190, 191, 362/105, 106, 103, 205; 2/422, 6.2; 224/181

(56) References Cited

U.S. PATENT DOCUMENTS

| | | | | |
|---|---|---|---|---|
| 4,406,040 | A | 9/1983 | Cannone | 362/106 |
| 4,887,194 | A | 12/1989 | Fields | 362/105 |
| 4,991,068 | A | 2/1991 | Mickey | 362/106 |
| 5,199,780 | A | 4/1993 | Ekman | 362/106 |
| 5,438,494 | A | 8/1995 | Harlan | 362/106 |
| 5,460,346 | A | 10/1995 | Hirsch | 248/229.13 |
| 5,463,538 | A | 10/1995 | Womack | 362/106 |
| 5,485,357 | A | 1/1996 | Zolninger | 362/103 |
| D370,740 | S | 6/1996 | Rance | D26/138 |
| 5,541,816 | A | 7/1996 | Miserendino | 362/106 |
| 5,608,919 | A | 3/1997 | Case | 362/106 |
| 5,658,065 | A | 8/1997 | Jamieson | 362/106 |
| 5,664,868 | A | 9/1997 | Montalbano et al. | 362/105 |
| 5,673,502 | A | 10/1997 | Caterbone | 362/103 |
| 5,690,416 | A | 11/1997 | Van Gennep | 362/191 |
| 5,692,268 | A | 12/1997 | Case | 24/16 BB |
| D401,005 | S | 11/1998 | Ludbrook et al. | D26/138 |
| 5,893,496 | A | 4/1999 | Katz et al. | 224/181 |
| 5,894,604 | A | 4/1999 | Crabb et al. | 362/106 |
| 6,206,543 | B1 | 3/2001 | Henry | 362/191 |
| 6,250,769 | B1 | 6/2001 | Kirk | 362/106 |
| 6,315,426 | B1 | 11/2001 | Buller, Jr. | 362/108 |
| 6,352,383 | B1 | 3/2002 | Ristola | 403/254 |
| 6,497,493 | B1 * | 12/2002 | Theisen | 362/105 |

* cited by examiner

*Primary Examiner*—Laura K. Tso
(74) *Attorney, Agent, or Firm*—Pitts & Brittian, P.C.

(57) ABSTRACT

A flashlight holder for use with a conventional hart hat to releasably receive a flashlight of the type defining a faceted barrel and a head which is rotatable relative to the barrel for operation of the flashlight. The flashlight holder is designed such that a flashlight is operable with one hand when retained in the flashlight holder. The flashlight holder defines a barrel support secured to a base. The barrel support defines an interior surface and a slot configured to cooperate to closely receive and retain the flashlight barrel in a non-rotatable manner. The base of the flashlight holder defines a tab configured to be releasably engaged within a slotted receptacle defined by the hard hat. A locking projection extends from the tab for engaging a lower edge of the hard hat.

17 Claims, 7 Drawing Sheets

HARD HAT MOUNTED FLASHLIGHT HOLDER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to the field of flashlights and holders for holding flashlights.

2. Description of the Related Art

Flashlights are useful because they are portable and lightweight. In certain situations, it is preferable to place the flashlight in a holder such that both of the user's hands are free. For instance, construction workers, electricians and maintenance workers often require the use of a flashlight and it is common to affix a holder to a hard hat and insert a flashlight in the holder. Some flashlights commonly used are operated by holding the barrel of the flashlight and twisting the head. Among the several disadvantages of using this type of flashlight in a holder is that it requires two hands to operate the flashlight, one hand being used to hold the barrel and the other to manipulate the head. Otherwise, the flashlight would rotate in the holder.

FIG. 1 illustrates a prior art device disclosed by Ludbrook et al., in U.S. Des. Pat. No. 401,005, issued on Nov. 10, 1998, which is provided for mounting a flashlight to the brim of a hat. The clip portion of the flashlight holder and the barrel support portion of the holder are parallel to each other. Although the barrel support portion supports the barrel of the flashlight, the barrel of the flashlight is not inhibited from rotation therein. Accordingly, in order to prevent such rotation, two hands are required to operate the flashlight as described above.

U.S. Pat. No. 4,406,040 issued on Sep. 27, 1983, to R. P. Connone discloses a flashlight holding implement which is attached to a hat brim for enabling the user to direct and adjust the angular position of the light beam. The '040 device includes a flashlight adapted with a clip, a flashlight supporting clip, and a hinge-type mechanism for selecting the angular position of the flashlight relative to the flashlight supporting clip.

U.S. Pat. No. 5,199,780 issued on Apr. 6, 1993, to J. M. Ekman discloses a hat attachment for receiving a flashlight in an orientation to project a beam of light forward of the wearer. Similarly, U.S. Pat. No. 5,438,494 issued on Aug. 1, 1995, to B. L. Harlan discloses a holder for a flashlight. Each holder defines an attachment device which is parallel to the flashlight barrel support portion such that the holder must be attached to one side of a hat or cap. The barrel support portion of each holder holds the flashlight barrel therein using only friction, which, under certain circumstances, will permit the rotation of the flashlight barrel therein.

U.S. Pat. No. 5,460,346 issued on Oct. 24, 1995, to N. Hirsch discloses an article holder which includes a clip and a clamp to which the clip is releasably securable. The clip defines an article holding portion which releasably holds a cylindrical article such as a flashlight. The article holding portion defines a configuration similar to the barrel support portion of the prior art illustrated in FIG. 1. As in previously discussed prior art devices, the cylindrical article is held in position via friction, which, under certain circumstances, will permit the rotation of the cylindrical article therein.

U.S. Pat. No. 5,463,538 issued on Oct. 31, 1995, to R. C. Womack discloses a portable light source which is mounted on a hat or cap via an adjustable mounting bracket. The light source includes a separate portable power source which communicates with the light source via an electrical connector. The mounting assembly must be secured to an object to support the light source and is not free standing.

U.S. Pat. No. 5,658,065 issued on Aug. 19, 1997, to J. Jamieson discloses a flashlight holder configured to be secured to a protective helmet, a hardhat or the like. The '065 device includes a carrier element adapted to receive a standard flashlight, an adjustment means connected to the carrier element and provided to adjust the carrier element and the flashlight to the position required by the protective helmet wearer. A mounting adapter means is connected to the carrier element by the adjustment means and provided to releasably attach the holder to the protective helmet. The mounting adapter means includes a leaf and a resilient tong which are adapted to be received in a slot defined by the helmet. The adjustment means comprises a swivel ball-socket arrangement.

U.S. Pat. No. 5,664,868 issued on Sept. 9, 1997, to D. Montalbano et al., discloses a flashlight bracket for releasably securing a flashlight to a portion of a brim of a helmet. The flashlight bracket is adapted to receive a flashlight having a handle portion and a light emitting portion, the light emitting portion being disposed to emit a beam of light at an acute angle or at an approximate right angle with respect to the longitudinal axis of the handle portion of the flashlight. The flashlight bracket includes a face plate, a flashlight maintaining apparatus, a substantially C-shaped channel, and a face plate clamping apparatus. The flashlight maintaining apparatus is disposed on the face plate and is adapted to receive the handle portion of the flashlight. The substantially C-shaped channel is disposed on the lower portion of the face plate and cooperates with the face plate clamping apparatus to clamp the flashlight bracket to the helmet.

U.S. Pat. No. 5,894,604 issued on Apr. 20, 1999, to S. C. Crabb et al., discloses various types of head gear, each being provided with an aperture on either side adapted to loosely receive the barrel of a flashlight. The aperture is oriented such that the flashlight projects a beam of light forward of the wearer. In using the '604 device, the flashlight is illuminated and then inserted into the aperture.

Although not specifically directed to a device for mounting a flashlight to head gear, U.S. Pat. No. 5,673,502 issued on Oct. 7, 1997, to M. T. Caterbone teaches a light apparatus adapter for attachment to a sports shoe. The apparatus includes a toe shoe form adapted to be secured on the upper portion of a toe of a shoe. A strap is connected to the toe shoe form for circumscribing the heal of the shoe to which the toe shoe form is to be attached. A light is connected to the toe shoe form for focusing a beam of light in generally a direction forward of the toe shoe form to light the path ahead of the shoe wearer.

U.S. Pat. No. 6,206,543 issued to the inventor of the present device discloses a flashlight holder assembly for releasably receiving a flashlight of the type having head rotatable with respect to a barrel for operation thereof. The '543 device is specifically configured for receiving a flashlight having a barrel which defines a faceted exterior surface.

As illustrated in FIG. 2 of the present disclosure, the flashlight holder defines a barrel support and a base. The barrel support defines a faceted internal surface and a slot which cooperate to closely receive the barrel in a non-rotatable manner. The base defines a base plate to which the barrel support is secured. In one embodiment, the holder includes a clip which extends from the base plate and is positioned below the base plate and cooperates with the base plate to receive and retain the periphery of an article therein.

Other devices provided for holding a flashlight relative to another object are disclosed in the following U.S. Letters Patent:

| Patent No. | Inventor(s) | Issue Date |
|---|---|---|
| Des. 370,740 | R. H. Rance | Jun. 11, 1996 |
| 4,887,194 | T. R. Fields | Dec. 12, 1989 |
| 4,991,068 | S. A. Mickey | Feb. 5, 1991 |
| 5,485,357 | G. C. Zolninger | Jan. 16, 1996 |
| 5,541,816 | N. G. Miserendino | Jul. 30, 1996 |
| 5,608,919 | R. N. Case | Mar. 11, 1997 |
| 5,690,416 | J. Van Gennep | Nov. 25, 1997 |
| 5,692,268 | R. N. Case | Dec. 2, 1997 |
| 5,893,496 | R. Katz et al. | Apr. 13, 1999 |
| 6,250,769 | C. F. Kirk | Jun. 26, 2001 |
| 6,315,426 | D. P. Buller, Jr. | Nov. 13, 2001 |

BRIEF SUMMARY OF THE INVENTION

The present invention is a flashlight holder for use with a conventional hard hat without modification of the hard hat. The flashlight holder is designed such that a flashlight can be operated with one hand when retained in the flashlight holder. The flashlight holder is adapted to releasably receive a flashlight of the type defining a faceted barrel and a head which is rotatable relative to the barrel for operation of the flashlight.

The flashlight holder defines a barrel support which is secured to a base. The barrel support defines an interior surface and a slot which cooperate to closely receive the flashlight barrel. The interior surface of the barrel support is faceted for receiving the faceted exterior surface of the flashlight barrel and thereby retaining the flashlight in a non-rotatable manner. The slot permits the expansion of the barrel support to accommodate the flashlight barrel, thus creating a retaining force on the flashlight barrel when inserted therein. The flashlight barrel is linearly adjustable within the barrel support.

The hard hat is of a conventional configuration which includes a slotted receptacle defined on either side thereof for receiving various conventional attachments such as a face guard or other safety device. The base of the flashlight holder defines a tab extending from the base plate in a direction substantially orthogonal with respect to the longitudinal axis of the barrel support. The tab is configured to be releasably engaged within the slotted receptacle of the hard hat. A locking projection extends from the distal end of the tab in a direction opposite the barrel support for engaging a lower edge of the hard hat.

In order to facilitate a locking engagement of the flashlight holder tab within the hard hat slotted receptacle, the tab is fabricated from a resilient material such that as the tab is inserted into the slotted receptacle, the tab flexes to accommodate passage of the locking projection. When the locking projection passes the lower edge of the hard hat, the tab snaps back toward its initial configuration, whereby the locking projection is engaged under the hard hat lower edge and prevents unselected removal of the flashlight holder. The tab remains partially flexed when engaged within the slotted receptacle such that the flashlight holder is held tightly as a result of the bias of the tab. In order to remove the flashlight holder from the hard hat, the tab is flexed to disengage the locking projection. The flashlight holder is then lifted to remove the tab from within the slotted receptacle.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A flashlight holder incorporating various features of the present invention is illustrated generally at 10 in the figures. The flashlight holder 10 is fabricated from a one-piece construction and is adapted to be releasably mounted in a conventional hart hat 50.The flashlight holder 10 is designed such that a flashlight 12 can be operated with one hand when retained in the flashlight holder 10. Further, the flashlight holder 10 is adapted to releasably receive the flashlight 12 such that the flashlight 12 is useful both as a handheld device and as a hard hat-mounted device when employed in situations where it is necessary or otherwise desirable to have both hands free. The flashlight holder 10 is further adapted to be of a small size such that if required, the flashlight holder 10 is easily removed and placed in the user's pocket for temporary storage. The small size of the flashlight holder 10 of the present invention further lends itself to being less restrictive regarding potential interference between the flashlight 12 and the environment in which the user is deployed. Specifically, the flashlight holder 10 presents a reduced risk of the user hitting an object with the flashlight 12, thereby reducing the risk that movement in a close environment will cause accidental removal of the hard hat.

Figure 1:
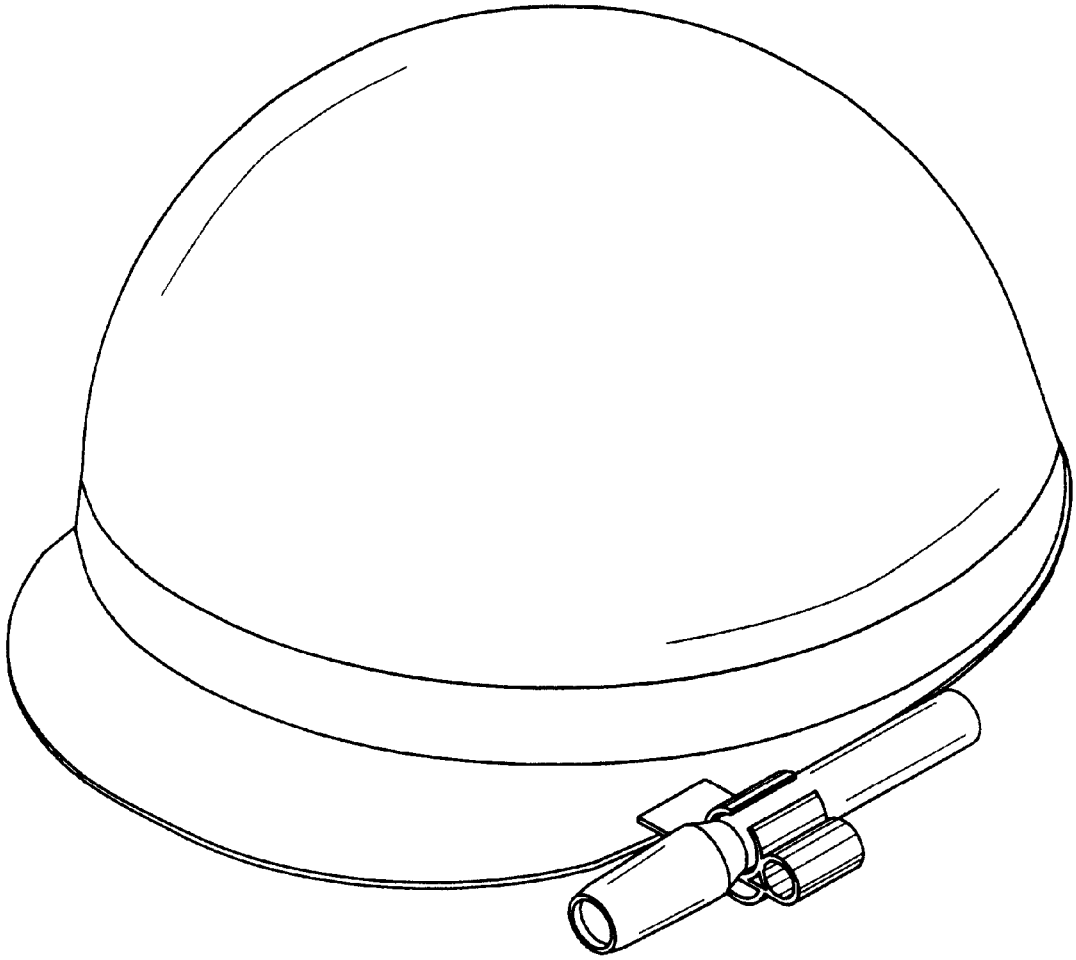
Fig. 1 (PRIOR ART)
FIG. 1 is a perspective view of a prior art device wherein a flashlight is retained within a holder and the holder is clipped to a hat.
Figure 2:
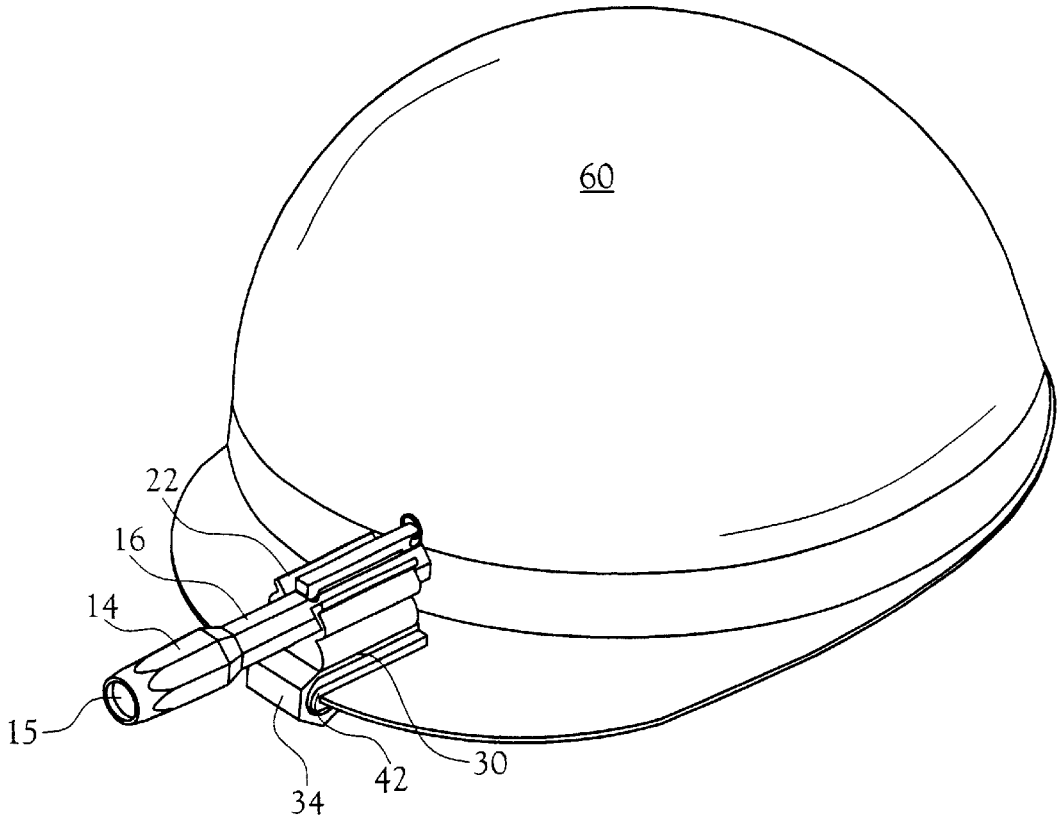
Fig.2 (PRIOR ART)
FIG. 2 is a perspective view of a further prior art device as disclosed in U.S. Pat. No. 6,206,543 issued to the inventor of the present invention.
Figure 3:
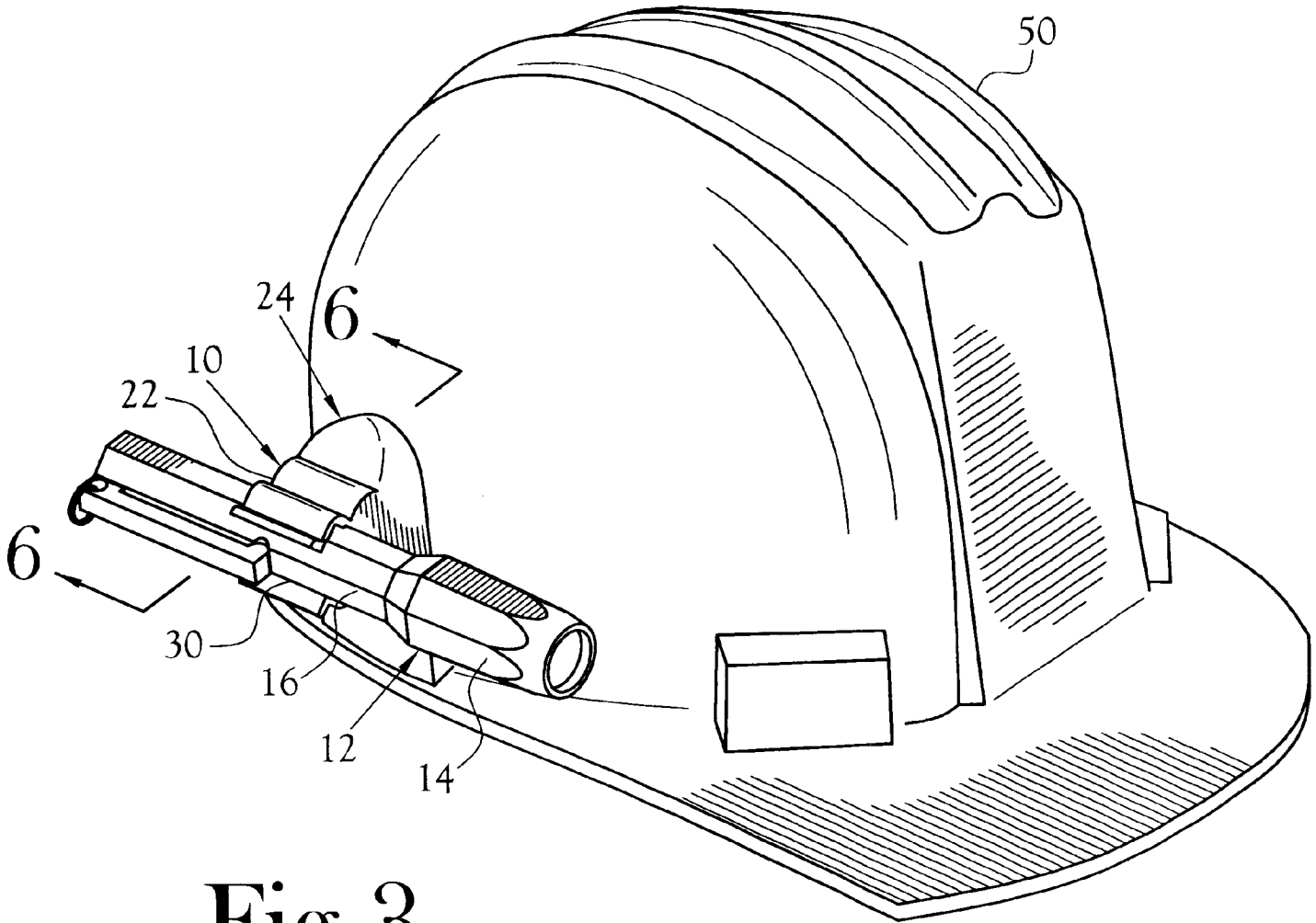
FIG. 3 is a perspective view of the hard had mounted flashlight holder of the present invention constructed in accordance with several features of the present invention and shown being mounted on a conventional hard hat.

As illustrated in FIG. 3, the flashlight holder 10 of the present invention is configured to be mounted on a conventional hard hat, without modification of the hard hat. The flashlight holder 10 is adapted to releasably receive a flashlight 12. The flashlight 12 defines a barrel 16 and a head 14. The head 14 is rotatable relative to the barrel 16 for operation of the flashlight 12. This operation of the flashlight 12 is well known in the art. The exterior surface 18 of the barrel 16 is faceted. In the illustrated embodiment, the flashlight barrel exterior surface 18 defines eight faces 20, as most clearly illustrated in FIG. 6.

Generally, the flashlight holder 10 defines a barrel support 22 which is secured to a base 24. In the illustrated embodiment, the barrel support 22 is integrally formed with the base 24 as well as the remaining elements of the flashlight holder 10, whereby the flashlight holder 10 is fabricated in a one-piece construction. The barrel support 22 defines an interior surface 26 and a slot 30 which cooperate to closely receive the exterior surface 18 of the barrel 16 of the flashlight 12. Specifically, the interior surface 26 is faceted for receiving the faceted exterior surface 18 of the barrel 16 of the flashlight 12 and retaining it in a non-rotatable manner therein. The slot 30 permits the expansion of the interior surface 26 to accommodate the barrel 16 of the flashlight 12, thus creating a retaining force on the flashlight barrel 16 when inserted therein. The flashlight barrel 16 is linearly adjustable within the barrel support 22. In the preferred embodiment, the barrel support 22 defines four faces 28 which are configured to contact four alternating faces 20 of the faceted exterior surface 18 of the flashlight barrel 16, shown most clearly in FIG. 6.

Figure 4:
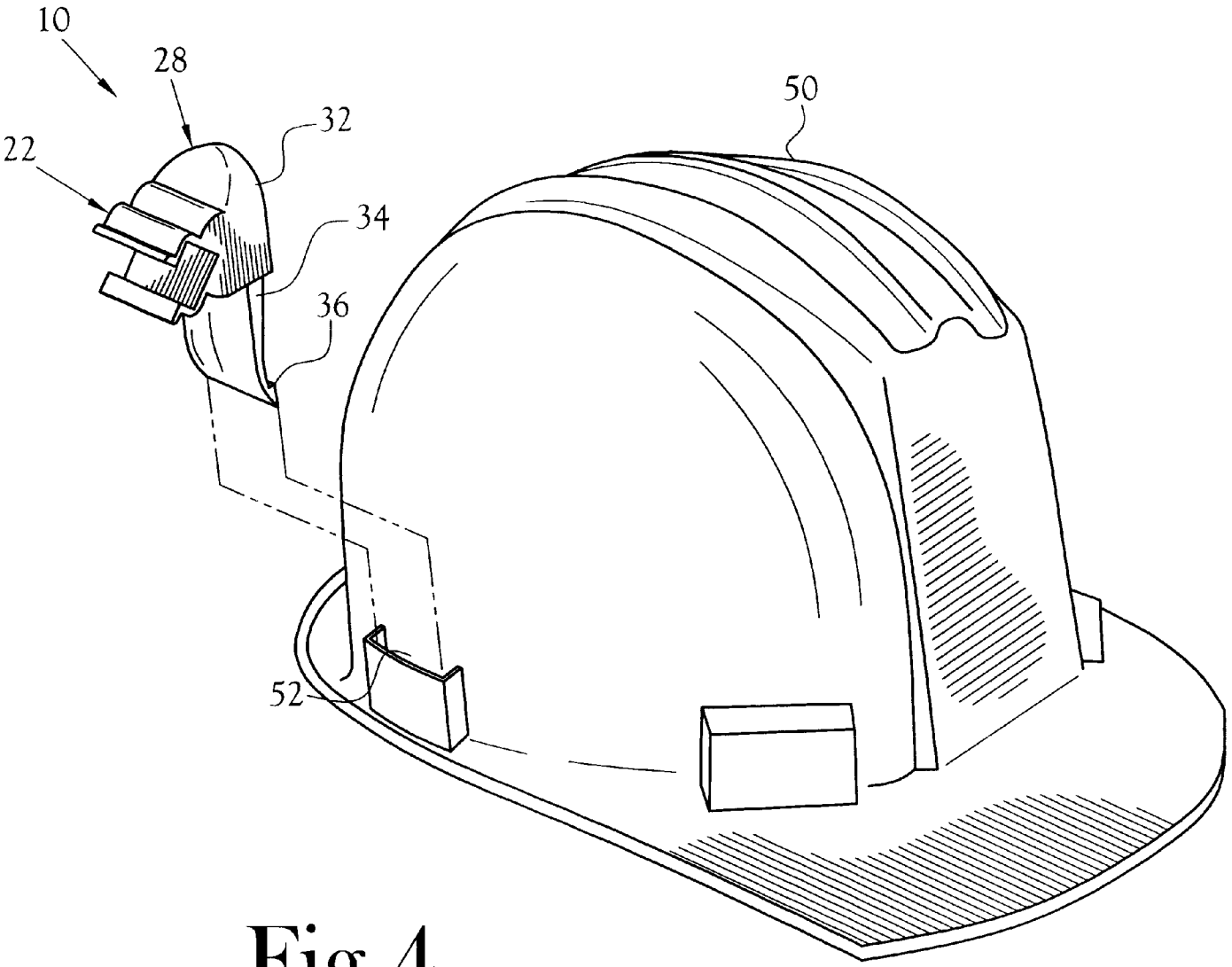
FIG. 4 is an exploded perspective view of the flashlight holder of FIG. 3, better illustrating the engagement mechanism between the flashlight holder and the hard hat.

Referring to FIG. 4, the hard hat 50 defines a conventional configuration. Specifically, a slotted receptacle 52 is defined on either side of the hard hat 50 for receiving various conventional attachments. Typically, the slotted receptacle 52 is provided for mounting a face guard (not shown) or other safety device.

Figure 5:
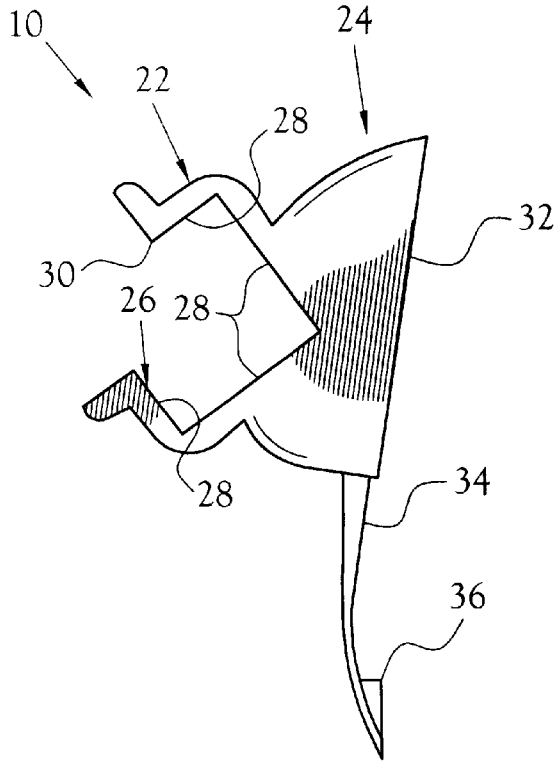
FIG. 5 is an end elevation view of the flashlight holder of FIG. 3.
Figure 6:
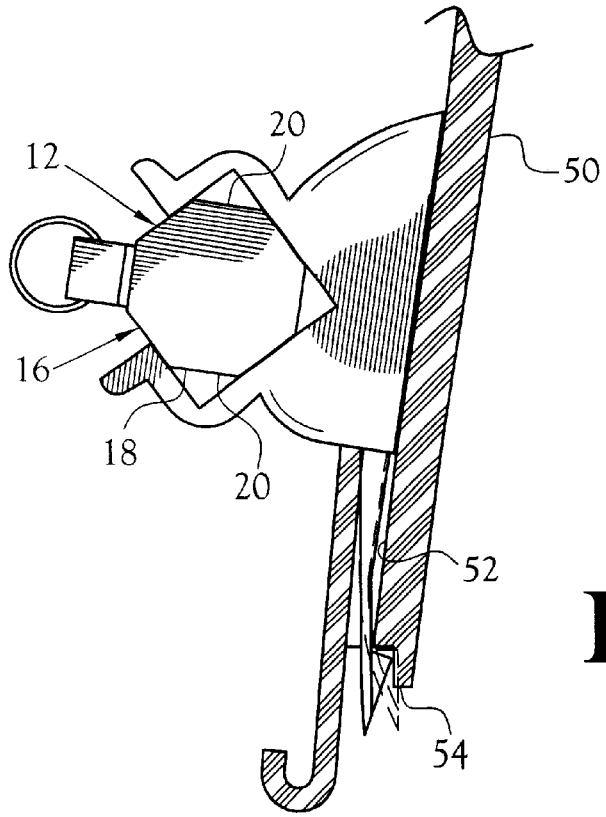
FIG. 6 is an end elevation view of the flashlight holder of the present invention being mounted in a hard hat, in section, taken along 6—6 of FIG. 3.

Illustrated in FIGS. 4–6, the base 28 of the flashlight holder 10 serves to support the barrel support 22 thereon and includes at least a base 24 defining a surface 32 adapted to substantially follow the contour of the hard had 50. Because the surface 32 of the base 24 is so configured, the risk of objects becoming lodged between the flashlight holder 10 and the hard hat 50 is substantially reduced, especially as compared to devices of the prior art. By reducing such risk, the risk of the hard hat 50 being unselectively removed from the wearer is likewise reduced.

A tab 34 extends from the base plate in a direction substantially orthogonal with respect to the longitudinal axis of the barrel support. In the present invention, the tab 34 extending from the base 24 is configured to be releasably engaged within the slotted receptacle 52. A locking projection 36 extends from the distal end of the tab 34 in a direction opposite the barrel support 22. As best illustrated in FIG. 6, the locking projection 36 is provided for engaging a lower edge 54 of the hard hat 50.

In order to facilitate a locking engagement of the flashlight holder tab 34 within the hard hat slotted receptacle 52, the tab 34 is fabricated from a resilient material such that as the tab 34 is inserted into the slotted receptacle 52, the tab 34 flexes to accommodate passage of the locking projection 36. When the locking projection 36 passes the lower edge 54 of the hard hat 50, the tab 34 snaps back toward its initial configuration, whereby the locking projection 36 is engaged under the hard hat lower edge 54 to prevent unselected removal of the flashlight holder 10. In an alternate embodiment of the hard hat 50 (not illustrated) wherein the bottom of the slotted receptacle 52 does not correspond to the or the lower edge 54 of the hard hat 50, the locking projection 36 engages the bottom edge of the slotted receptacle 52 to prevent unselected removal of the flashlight holder 10. The tab 34 remains partially flexed when engaged within the slotted receptacle 52 such that the flashlight holder 10 is held tightly as a result of the bias of the tab 34. In order to remove the flashlight holder 10 from the hard hat 50, the tab 34 is flexed to disengage the locking projection 36. The flashlight holder 10 is then lifted to remove the tab 34 from within the slotted receptacle 52.

Figure 7:
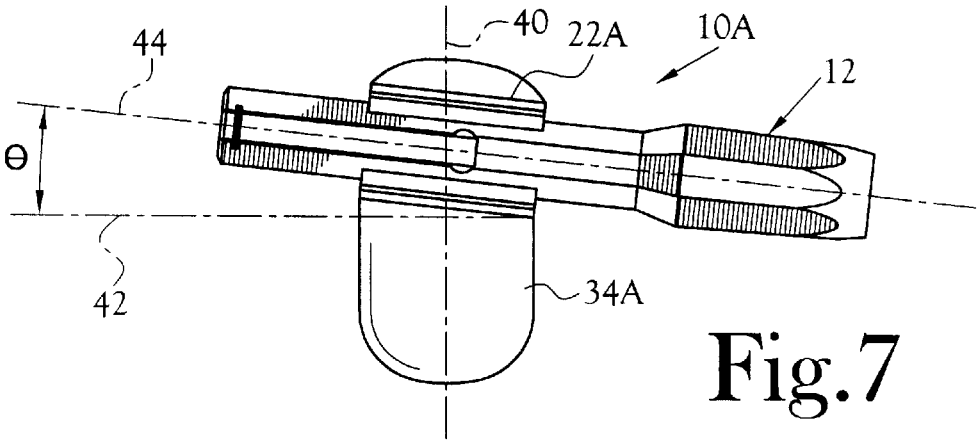
FIG. 7 is a front elevation view of an alternate embodiment of the hard had mounted flashlight holder of the present invention constructed in accordance with several features of the present invention.
Figure 8:
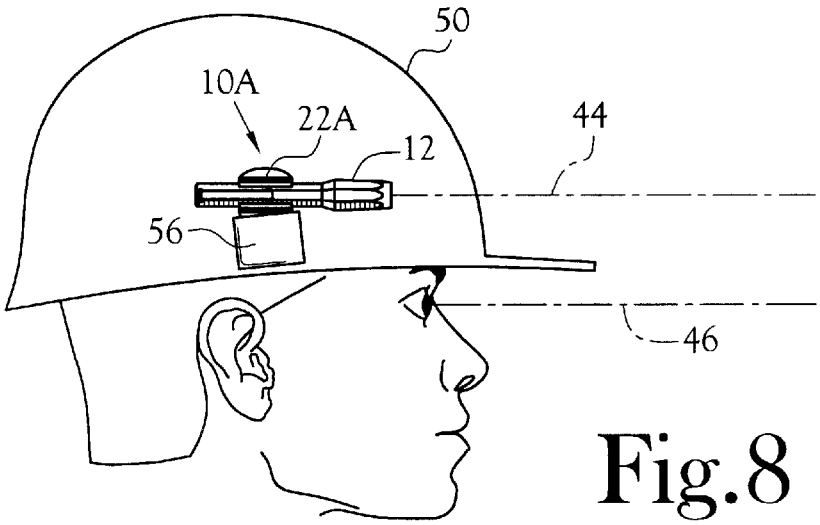
FIG. 8 is a front elevation view of the flashlight holder of FIG. 7 shown mounted on one side of a hard hat such that the flashlight is directed at an angle substantially parallel to the line of sight of the user.
Figure 9:
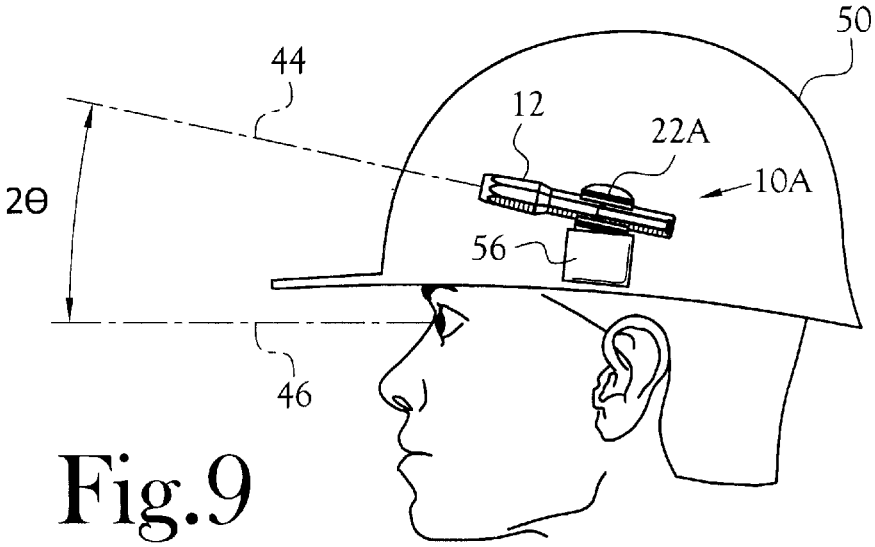
FIG. 9 is a front elevation view of the flashlight holder of FIG. 7 shown mounted on the opposite side of the hard hat, as compared to FIG. 8, such that the flashlight is directed at an angle above the line of sight of the user.

Illustrated in FIGS. 7–9 is an alternate embodiment of the flashlight holder 10 of the present invention. In the prior embodiment, the longitudinal axis of the barrel support 22 is orthogonal to the longitudinal axis of the tab 34. The flashlight holder 10A is substantially similar to the flashlight holder 10 as described above. However, the flashlight holder 10A includes a barrel support 22A whose longitudinal axis 44 is disposed an angle Θ with respect to the orthogonal 42 of the longitudinal axis 40 of the tab 34A.

The offset angle Θ is provided for two primary purposes. First, it will be seen most clearly in FIG. 8 that when the hard hat 50 is worn, the slotted receptacle 52 may be disposed at an angle Θ with respect to the line of sight 46 of the wearer. Therefore, when the flashlight holder 10A is secured within the slotted receptacle 52 on the right hand side of the hard hat 50 and the hard hat 50 is worn, the flashlight 12 is disposed parallel to line of sight 46 of the wearer. It will be understood that the angle e may be reversed so that the flashlight 12 is disposed parallel to the user's line of sight 46 when worn on the left side of the hard hat 50, especially when worn by left-handed users. In either case, the flashlight 12 is positioned closest the side used most by the user in order to ensure maximum light in the desired areas.

Second, the offset angle Θ is provided for adjustability of the angle of the light beam. Specifically, as illustrated in FIG. 9, when the flashlight holder 10A is disposed within the slotted receptacle 52 on the left hand side of the hard hat 50 and the flashlight 12 is reoriented in the barrel support 22A, the flashlight. 12 is disposed at an offset of 2Θ with respect to the line of sight 46 of the user. As a result, the flashlight 12 is directed to a location other than immediately in front of the user. This is especially useful in situations where the user's eyes are looking up with respect to his head as a result of being is a position that will not allow the head to be directly facing the object being illuminated. Such is the case, for example, when the user is crawling on his hands and knees in a crawl space, or when inspecting something overhead. Further, although the flashlight holder 10A defines a one-piece construction, adjustability of the light beam is accomplished.

The degree of the angle Θ is adapted to the particular hard hat 50 on which the flashlight holder 10A is being mounted. Typically, the angle Θ is in the range from about 3 degrees to about 10 degrees. However, the present invention is not limited to such range, as it is foreseeable that particular applications will require angles not in this range.

Figure 10:
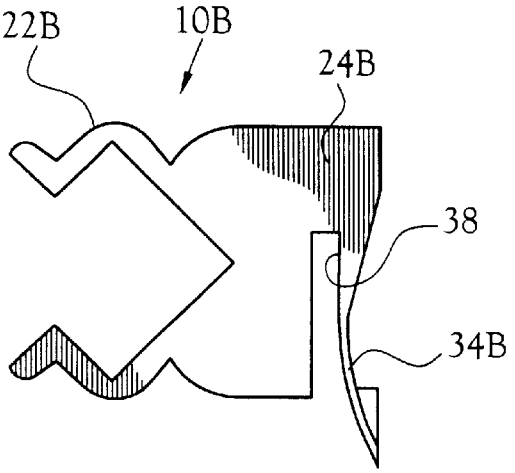
FIG. 10 an end elevation view of a further alternate embodiment of the flashlight holder of the present invention constructed in accordance with several features of the present invention.
Figure 11:
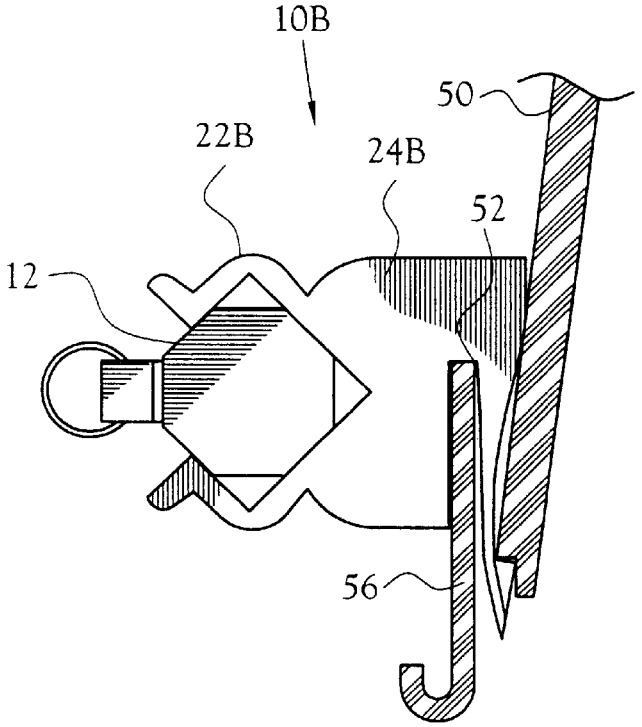
FIG. 11 is an end elevation view of the flashlight holder of FIG. 10 being mounted in a hard hat, in section.

FIGS. 10 and 11 illustrate a further alternate embodiment of the flashlight holder 10B of the present invention. The flashlight holder 10B includes similar elements to the embodiments described above. However, the barrel support 22B is secured to a base 24B and is positioned in front of a tab 34B in a spaced-apart relationship such as to define a slot 38. The slot 38 is adapted to receive a portion 56 of the hard hat 50 which defines the slotted receptacle 52. The remaining elements are as described above. By disposing the barrel support 22B and ultimately the flashlight 12 lower with respect to the line of the sight of the user, the light beam is focused more closely on the exact area being viewed by the wearer. Further, the lower profile of the flashlight holder 10B reduces the risk of interference with objects in the environment in which the user is working. As in the previous embodiments, the barrel support 22B is disposed at either a right angle or an acute angle relative to the tab 34B as required.

From the foregoing description, it will be recognized by those skilled in the art that a flashlight holder offering advantages over the prior art has been provided. Specifically, the flashlight holder assembly is fabricated from a one-piece construction and is adapted to be mounted on a conventional hard hat without requiring modification of the hard hat. Moreover the flashlight holder assembly is designed such that the flashlight is operable with one hand when retained in the holder assembly. Further, as a result of the configuration of the flashlight holder, including the low profile and the base being adapted to match the contour of the hard hat, the hard hat may be easily removed and stored with the flashlight holder left in place, thereby reducing the risk of the flashlight holder being misplaced. However, because the flashlight holder is easily removable from the hard hat, it may be removed and easily carried on a person, such as in a pocket, in a tool belt pouch, or in the various other manners described in the '543 patent.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the general inventive concept.

I claim:

1. A flashlight holder for releasably receiving a flashlight and for being releasably mounted on a conventional hard hat defining a slotted receptacle on at least one side thereof, the flashlight including a faceted barrel and a head, the head being rotatable with respect to the barrel for operation of the flashlight, said flashlight holder assembly comprising:

a barrel support defining a faceted internal surface adapted to closely receive the faceted flashlight barrel, said barrel support preventing rotation of the flashlight barrel such that operation of the flashlight by rotation of the flashlight head does not impart rotation of the flashlight barrel, said barrel support further defining a slot along a length thereof to assist in opening said barrel support for receipt of the flashlight barrel; and a base defining a base plate, said barrel support being secured to an upper surface of said base plate, said base further defining a tab adapted to be releasably engaged within the slotted receptacle defined by the hard hat whereby the flashlight is directed in front of the wearer of the hard hat.

2. The flashlight holder of claim 1 wherein said faceted internal surface of said barrel support defines fewer faces than said faceted exterior surface of said barrel.

3. The flashlight holder of claim 1 wherein said tab defines a locking projection extending from a distal end of said tab away from said barrel support, said locking projection being provided for engaging a lower edge of the hard hat, thereby preventing unselected removal of said flashlight holder from the hard hat slotted receptacle.

4. The flashlight holder of claim 3 wherein said tab is fabricated from a resilient material such that as said tab is inserted into the slotted receptacle of the hard hat, said tab is flexed to accommodate passage of said locking projection, said tab being at least partially relaxed upon passage of said locking projection through said slotted receptacle and engaging the lower edge of the hard hat.

5. The flashlight holder of claim 4 wherein said tab remains partially flexed after said locking projection is engaged with the lower edge of the hard hat, thereby retaining said flashlight holder securely in position within said slotted receptacle.

6. The flashlight holder of claim 1 wherein said base plate further defines a lower surface adapted to substantially conform to a portion of the conventional hard hat, whereby when said flashlight holder is mounted on the conventional hard hat, said flashlight holder is closely held to the surface of the conventional hard hat.

7. The flashlight holder of claim 1 wherein a longitudinal axis of said barrel support is disposed substantially orthogonally to a longitudinal axis of said tab.

8. The flashlight holder of claim 1 wherein a longitudinal axis of said barrel support is disposed at an acute angle relative to a longitudinal axis of said tab such that the flashlight is disposed substantially parallel to a line of sight of the wearer when said flashlight holder is mounted on a first side of the hard hat, and whereby the flashlight is disposed at angle approximately twice said acute angle above the line of sight of the wearer when said flashlight holder is mounted on a second side of the hard hat.

9. The flashlight holder of claim 1 wherein said base is configured such that said barrel support and said tab are disposed in a spaced apart relationship with each other to define a slot adapted to receive a portion of the hard hat defining the slotted receptacle.

10. The flashlight holder of claim 9 wherein a longitudinal axis of said barrel support is disposed at an acute angle relative to a longitudinal axis of said tab such that the flashlight is disposed substantially parallel to a line of sight of the wearer when said flashlight holder is mounted on a first side of the hard hat, and whereby the flashlight is disposed at angle approximately twice said acute angle above the line of sight of the wearer when said flashlight holder is mounted on a second side of the hard hat.

11. A flashlight holder for releasably receiving a flashlight and for being releasably mounted on a conventional hard hat defining a slotted receptacle on at least one side thereof, the flashlight including a faceted barrel and a head, the head being rotatable with respect to the barrel for operation of the flashlight, said flashlight holder assembly comprising:

a barrel support defining a faceted internal surface adapted to closely receive the faceted flashlight barrel, said barrel support preventing rotation of the flashlight barrel such that operation of the flashlight by rotation of the flashlight head does not impart rotation of the flashlight barrel, said barrel support further defining a slot along a length thereof to assist in opening said barrel support for receipt of the flashlight barrel; and a base defining a base plate, said barrel support being secured to an upper surface of said base plate, said base further defining a tab adapted to be releasably engaged within the slotted receptacle defined by the hard hat whereby the flashlight is directed in front of the wearer of the hard hat, said tab defining a locking projection extending from a distal end of said tab away from said barrel support, said locking projection being provided for engaging a lower edge of the hard hat, thereby preventing unselected removal of said flashlight holder from the hard hat slotted receptacle, said tab being fabricated from a resilient material such that as said tab is inserted into the slotted receptacle of the hard hat, said tab is flexed to accommodate passage of said locking projection, said tab being at least partially relaxed upon passage of said locking projection through said slotted receptacle and engaging the lower edge of the hard hat, said base plate further defining a lower surface adapted to substantially conform to a portion of the conventional hard hat, whereby when said flashlight holder is mounted on the conventional hard hat, said flashlight holder is closely held to the surface of the conventional hard hat.

12. The flashlight holder of claim 11 wherein said faceted internal surface of said barrel support defines fewer faces than said faceted exterior surface of said barrel.

13. The flashlight holder of claim 11 wherein said tab remains partially flexed after said locking projection is engaged with the lower edge of the hard hat, thereby retaining said flashlight holder securely in position within said slotted receptacle.

14. The flashlight holder of claim 11 wherein a longitudinal axis of said barrel support is disposed substantially orthogonally to a longitudinal axis of said tab.

15. The flashlight holder of claim 11 wherein a longitudinal axis of said barrel support is disposed at an acute angle relative to a longitudinal axis of said tab such that the flashlight is disposed substantially parallel to a line of sight of the wearer when said flashlight holder is mounted on a first side of the hard hat, and whereby the flashlight is disposed at angle approximately twice said acute angle above the line of sight of the wearer when said flashlight holder is mounted on a second side of the hard hat.

16. The flashlight holder of claim 11 wherein said base is configured such that said barrel support and said tab are disposed in a spaced apart relationship with each other to define a slot adapted to receive a portion of the hard hat defining the slotted receptacle.

17. The flashlight holder of claim 16 wherein a longitudinal axis of said barrel support is disposed at an acute angle relative to a longitudinal axis of said tab such that the flashlight is disposed substantially parallel to a line of sight of the wearer when said flashlight holder is mounted on a first side of the hard hat, and whereby the flashlight is disposed at angle approximately twice said acute angle above the line of sight of the wearer when said flashlight holder is mounted on a second side of the hard hat.

* * * * *